United States Patent [19]

Denz

[11] Patent Number: 4,803,966

[45] Date of Patent: Feb. 14, 1989

[54] ENGINE CONTROL SYSTEM

[75] Inventor: Helmut Denz, Stuttgart, Fed. Rep. of Germany

[73] Assignee: Robert Bosch GmbH, Stuttgart, Fed. Rep. of Germany

[21] Appl. No.: 173,553

[22] Filed: Mar. 25, 1988

[30] Foreign Application Priority Data

Mar. 27, 1987 [DE] Fed. Rep. of Germany ..... 3710081

[51] Int. Cl.[4] ..... F02D 41/30; F02D 43/00

[52] U.S. Cl. ..... 123/478; 123/412; 123/486

[58] Field of Search ..... 123/478, 486, 412, 480

[56] References Cited

U.S. PATENT DOCUMENTS

| | | | |
|---|---|---|---|
| 4,572,142 | 2/1986 | Arnold et al. | 123/478 |
| 4,582,031 | 4/1986 | Janetzke et al. | 123/478 |
| 4,590,563 | 5/1986 | Matsumura et al. | 123/412 |

FOREIGN PATENT DOCUMENTS

| | | | |
|---|---|---|---|
| 59-103928 | 6/1984 | Japan | 123/478 |

*Primary Examiner*—Andrew M. Dolinar
*Attorney, Agent, or Firm*—Walter Ottesen

[57] ABSTRACT

The invention is directed to an engine control system wherein fuel injection and ignition is dependent upon elevation. In this system, the elevation is detected via the maximum charge signal in the full-load operation of the engine. For this purpose, characteristic curves for the maximum fuel quantity corresponding to various elevation values are stored. A limitation of the maximum charging signal is carried out in the specific speed range in dependence upon the detection elevation in order to prevent overenriching by means of pulsations. Furthermore, a correction ignition angle adapted to the particular elevation and a corrosion factor for the injection time are effective which makes possible a full-load adaption of the motor at the elevation.

9 Claims, 3 Drawing Sheets

ENGINE CONTROL SYSTEM

FIELD OF THE INVENTION

The invention relates to an engine control system wherein fuel injection is dependent upon elevation. The system includes a load sensor for determining engine charge and a speed sensor.

BACKGROUND OF THE INVENTION

It is known to control the injection of fuel for internal combustion engines in dependence upon the particular elevation at which the engine operates. According to the actual operating elevation above standard zero, a so-called elevation correction is undertaken to adapt the particular quantity of fuel fed to the engine for maintaining preset mixture components of the air/fuel mixture with decreasing air density. In this way, it is prevented that an increasingly rich mixture is fed to the engine in a motor vehicle which moves between various elevations, for example, starting at sea level and driving into the mountains. An increasingly rich mixture not only increases fuel consumption, it also effects a reduction in power.

In fuel-injection apparatus, various load sensors are provided for detecting the actual air mass supplied to the engine. The load signal issued by the load sensor is usually combined with further operating-characterizing parameters from which the duration of injection or the injected quantity for the fuel injection is determined. An elevation-dependent reduction of the injected fuel can be provided to prevent the fuel mixture from becoming overrich. To achieve this, it is known to provide an altimeter in motor vehicles and to correct the injected quantity of fuel or the ignition angle in dependence upon its measurement signal. Such an elevation correction requires an additional elevation sensor and therefore involves increased cost.

SUMMARY OF THE INVENTION

The engine control system according to the invention affords the advantage that no elevation sensor is required since different operating elevations are detected indirectly via the maximum charge signal determined by the load sensor. Characteristic curves for the maximum charging signal are stored in a memory and correspond to different elevation values. These characteristic curves are compared with actual values of the maximum charge for the full-load signal and a specific elevation is detected as soon as the actual value drops below the corresponding value of a characteristic curve. For example, it can be concerned with a characteristic curve which provides the course of the charge in dependence upon the rotational speed for an elevation of 1000 meters above standard zero. The charge course is dependent upon the particular type of engine and therefore the characteristic curves for each engine type must be determined in order to then store these characteristic curves in a memory as data specific to the engine.

After dropping below a characteristic curve, the charge-quantity limit is switched to this characteristic curve only after a delay time and a deduction of a hysteresis value to prevent a continuous back-and-forth switching between different elevations. In this way, the system is provided with a hysteresis which prevents an oscillation in the limit region.

A switch-over to a higher characteristic curve can then occur when the measured actual values of the charge signal exceed a neighboring higher characteristic curve.

The preferred embodiment of the engine control system of the invention provides that a lower rotational speed range is determined within which an elevation switch-over in dependence upon the instantaneous charge signal does not occur. More specifically, pulsations occur at low rotational speeds which can correspond to individual induction strokes of the engine and can lead to a high charge signal. Therefore, the lower speed range can also be designated as a pulsating speed range. In order to prevent an overenrichment in this range, a special charge-quantity limit can be provided for this range after a detection of elevation. This special charge-quantity limit lies very slightly above the values of the corresponding characteristic curve stored in memory.

An optimization of the elevation correction is obtained by means of an appropriate elevation-dependent ignition angle correction. For this purpose, elevation-dependent ignition angle characteristic curves can be stored as characteristics specific to the engine and can then be utilized at the particular operating elevation detected for adjusting the ignition angle. In the same way, correction factors can be called up in dependence upon the detected elevation in systems for which no elevation-dependent mixture correction occurs such as for air-quantity systems and pressure systems without lambda control.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
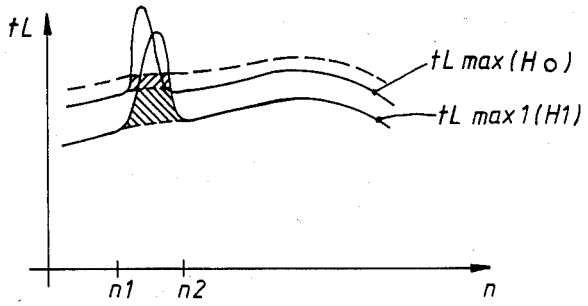
FIG. 1 is a graph showing the course of the charge signal as a function of rotational speed without elevation-dependent characteristic curves for maximum charge.

In the diagram of FIG. 1, the course of the charge signal tL is shown in dependence upon rotational speed n. The charge signal tL has a value corresponding to the engine charge which constitutes a base injection time for determining the duration of injection which is corrected by means of various factors. The duration of injection and therefore the quantity of fuel injected are linearly dependent upon the charge signal tL.

The characteristic curve tLmax (HO) shows the maximum charge quantity at sea level. The characteristic curve shown by the broken line and running slightly above this characteristic curve tLmax (HO) constitutes a tLmax-limitation. The characteristic arranged therebeneath, namely the tLmaxl (Hl) characteristic curve, shows the rotational speed-dependent course of the actual values for the fuel quantity at a specific elevation.

Overrichness of the air mixture can occur in the rotational speed range of nl to n2 because of pulsations or return-flow errors. This overrichness is shown in FIG. 1 by the hatched areas.

Figure 2:
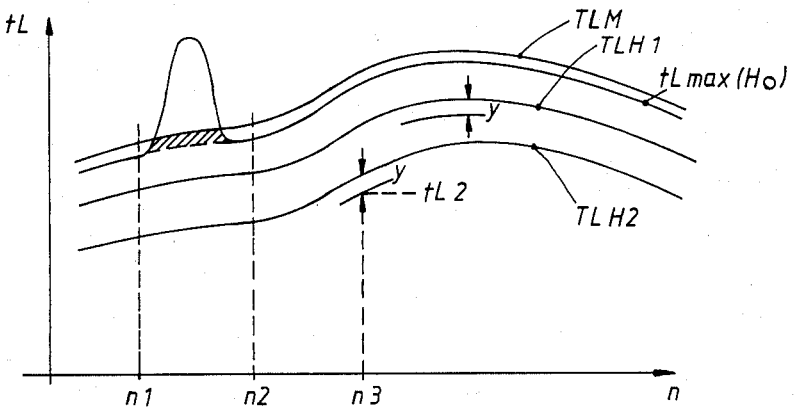
FIG. 2 is a graph showing the course of the charge signal as a function of rotational speed and several characteristic curves for detecting various elevations.

FIG. 2 shows a speed-dependent characteristic curve TLM which lies slightly above the characteristic curve tLmax containing the tLmax-values reached at standard zero. The TLM characteristic curve is stored in a memory of the engine control system.

In order to consider variations from one engine to another, it is required that a certain spacing be maintained between the two characteristic curves TLM and tLmax and this can amount to, for example, 0.5 ms. The characteristic curve TLM therefore provides the maximum charge at sea level for a fully opened throttle flap, that is, this characteristic curve is then effective when a full-load switch monitoring the throttle flap position is closed or a speed-dependent angle of the throttle flap potentiometer is exceeded.

The characteristic curves TLH1 and TLH2 are also shown which are likewise stored in the memory of the engine control system. The two characteristic curves TLHl and TLH2 represent the speed-dependent course of the maximum charge at two different elevations H1 and H2. If the vehicle enters a certain elevation in which only the charge tL2 is still obtained with the full-load signal in a range n<nl or n>n2 (for example at a speed n3), then the elevation H2 is detected. The same applies when there is a drop below the characteristic curve TLH1 by the value y. For this, a certain delay time is provided with which the switch-over of the characteristic curves occurs with a delay. In this way, a hysteresis is provided for the system which prevents an oscillation of the control system. A switch-back to the next higher elevation only occurs again when the actual values of TL in the range n<n1 or n>n2 exceed the characteristic curve values of the characteristic curves TLH2 or TLH1 which are just then effective at full load signal.

Figure 3:
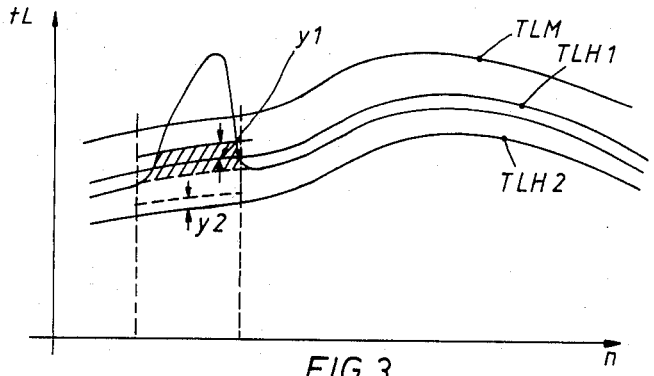
FIG. 3 is a graph showing the course of the charge signal as a function of rotational speed with a special charge limit in the pulsation range.

The range n1<n<n2 is introduced in order to prevent a defective switch-over for engines having large pulsation errors. In this range, a switch-back to the next lower elevation does not occur when elevations H1 or H2 are detected even when the values of the characteristic curves TLH1 and TLH2 are exceeded. For standard elevation, the charge quantity TL is limited in the pulsation-speed range nl to n2 by means of the characteristic curve TLM and a substantial overenriching is prevented. The maximum charge tL is limited to the value TLH1+y1 or TLH2+y2 after the elevation H1 or H2 is detected in order to prevent an overenriching also at the elevation. For this, y1 and y2 can have the same magnitude and can also both equal zero. An example corresponding thereto is illustrated in FIG. 3.

The function of the elevation correction can occur with time so that the correction remains stored when opening the full-load switch. An adaptation to elevation would occur when traveling in mountainous country with frequent full-load operation. This elevation adaptation could not be taken back with a subsequent drive into lower elevations without full-load operation. This can lead to an undesired knocking with a subsequent full-load operation at lower elevations. It is therefore provided that the elevation correction is carried out ony for the particular full-load operation and, after opening the full-load switch, the elevation correction is first switched back again to standard elevation.

Figure 4:
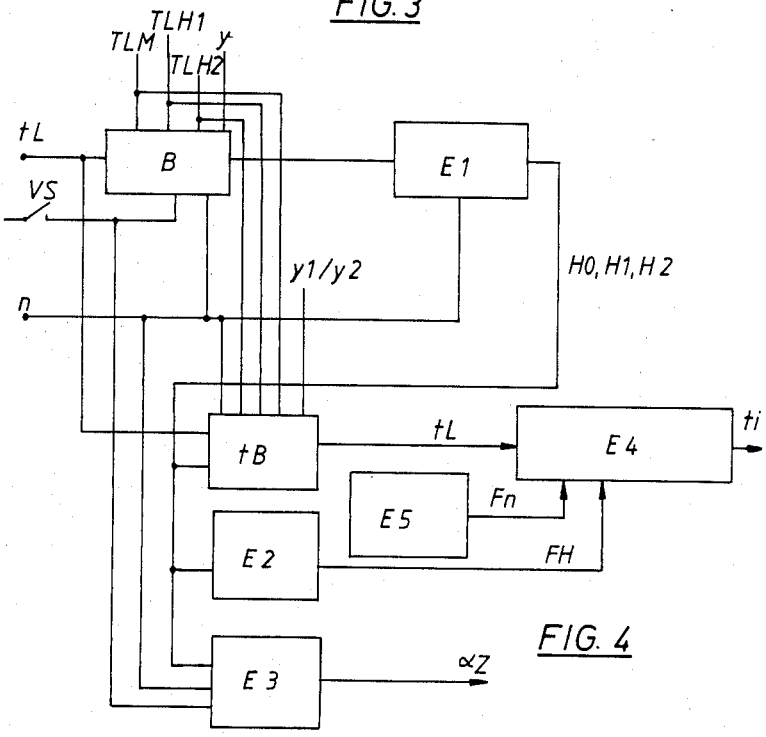
FIG. 4 is a block diagram of an embodiment of the engine control system according to the invention; and, FIG. 5 is a block diagram for making an ignition angle adjustment in dependence upon elevation.

FIG. 4 shows a block diagram of the engine control system. The actual values of the charge signal tL are directed to a range-recognition unit B the further ipputs of which monitor the full-load signal VS from the full-load switch or from the throttle-flap potentiometer and receive values of the characteristic curves TLM, TLH1, TLH2 and of the threshold value y. The rotational speed n is also applied to an input of the range-recognition unit B. In addition, an arrangement E1 is provided which maintains the particular elevation detected for the pulsation range nl to n2. The output of arrangement E1 is connected with the following: the input of a tLmax-limiter tB, an arrangement E2 and a further arrangement E3. The arrangement E2 forms an elevation-dependent factor FH which is directed to an arrangement E4 together with the limit tL-value. The arrangement E4 determines the injection duration ti from the factors which are supplied thereto. The further factors Fn, which are specific to the motor and dependent upon speed as may be required, are directed to the arrangement E4. The factors Fn are derived from the arrangement E5 which is not further illustrated. The arrangement tB, which limits the tL-value, is supplied at its input with the value y1 and/or y2 which limits overenriching in the pulsation range.

Figure 5:
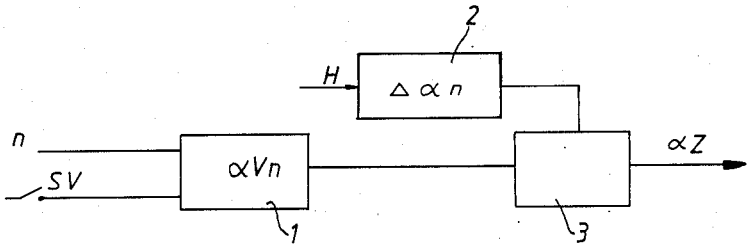

The unit E3 is provided for adjusting the ignition angle in dependence upon speed and elevation at full load and is illustrated in greater detail in FIG. 5.

The unit E3 comprises a switching arrangement 1 for determining the full-load ignition angle $\alpha$VN which is dependent upon speed n. In addition, an angle correction $\Delta\alpha$n, which is preferably dependent upon speed, is determined by means of a switching arrangement 2 in dependence upon the particular elevation H which can, for example, have the elevation value H0, H1 or H2. This angle correction $\Delta\alpha$n is combined in a further switching arrangement 3 with the ignition angle $\alpha$Vn at full load to the full load ignition angle $\alpha$z.

An expansion of the system at load signals which contain no pulsation errors can be provided by continuously detecting the elevation instead of the described two detectable elevations H1 and H2. The correction of the ignition angles or the corresponding correction factors can then likewise be continuous characteristic curves or characteristic fields in dependence upon the elevation and/or the rotational speed.

It is understood that the foregoing description is that of the preferred embodiments of the invention and that various changes and modifications may be made thereto without departing from the spirit and scope of the invention as defined in the appended claims.

What is claimed is:

1. An engine control system wherein the injection of fuel is dependent upon elevation, the system comprising:

a load sensor for determining the engine charge;

a rotational speed sensor for detecting engine speed;

first function means for storing a characteristic curve (TLM) indicative of the maximum charge and having values dependent upon said speed which are slightly above the actual values (tLmax) obtained at sea level (H0);

second function means for storing additional characteristic curves (TLH1, TLH2) for the maximum engine charge, said curves (TLH1, TLH2) corresponding to respective elevations (H1 and H2); and, comparison means for comparing the actual value of the load signal measured at full load with the stored characteristic curves (TLM, TLH1, TLH2) and for detecting the instantaneous elevation when there is a drop below any one of said additional characteristic curves (TLH1, TLH2).

2. The engine control system of claim 1, wherein a transition from one elevation (H1, H2) to another occurs only after a delay time during which the charge signal at full load is below the individual characteristic curves (TLH1, TLH2) by an amount corresponding to a hysteresis value (y).

3. The engine control system of claim 1, wherein a switch-over to a greater elevation (H0, H1) occurs after the directly adjacent lower value characteristic curve (TLH1, TLH2) is exceeded.

4. The engine control system of claim 1, wherein a lower rotational speed range (n1 to n2) is fixed within which an elevation switch-over does not occur in dependence upon the instantaneous charge signal.

5. The engine control system of claim 4, wherein a charge quantity limitation occurs in the lower speed range (n1 to n2) when the charge signal exceeds the characteristic curves (TLH1, TLH2), said limitation being slightly above the values of said characteristic curves (TLH1, TLH2).

6. The engine control system of claim 1, wherein a switch-over occurs to one of a plurality of ignition angle characteristic curves ($\alpha z$) in dependence upon the detected elevation values (H0, H1, H2) when the different characteristic curves (TLM, TLHl, TLH2) are exceeded or there is a drop therebelow, said switch-over occurring in correspondence to the elevation value detected.

7. The engine control system of claim 1, wherein an elevation correction factor (FHK1, FHK2) is switched in in dependence upon different elevation.

8. The engine control system of claim 1, wherein a continuous elevation correction occurs for a system having no pulsation errors 9. The engine control system of claim 1, wherein a speed dependent angle is adjusted for the generation of a full-load signal when a throttle flap potentiometer is used as a full-load signal transducer.

* * * * *